US005915029A

United States Patent [19]

Yazurlo et al.

[11] Patent Number: 5,915,029

[45] Date of Patent: Jun. 22, 1999

[54] AUTOMATED TESTING APPARATUS FOR ELECTRONIC COMPONENT

[75] Inventors: Donato Yazurlo, Hewitt, N.J.; Paul G. Russo, West Nyack, N.Y.; Lawrence Redner, San Diego, Calif.

[73] Assignees: Sony Corporation, Tokyo, Japan; Sony Electronics, Park Ridge, N.J.

[21] Appl. No.: 09/065,335

[22] Filed: Apr. 23, 1998

[51] Int. Cl.[6] ..... H04R 29/00

[52] U.S. Cl. ..... 381/58; 381/56; 381/98; 379/1; 379/6

[58] Field of Search ..... 381/56, 57, 58, 381/59, 96, 98, 101–2, 124; 379/1, 6, 10, 21–22, 25–27; 324/76.41, 76.57, 76.72, 500, 510–511, 527, 532, 755

[56] References Cited

U.S. PATENT DOCUMENTS

| | | | |
|---|---|---|---|
| 3,369,176 | 2/1968 | Palatinus | 324/76.57 |
| 3,805,155 | 4/1974 | Tsuda et al. | 324/133 |
| 4,144,490 | 3/1979 | Stevens | 324/7 |
| 4,346,268 | 8/1982 | Gearling | 381/58 |
| 4,370,650 | 1/1983 | Norrell | 324/76.57 |
| 4,520,503 | 5/1985 | Kirst et al. | 381/56 |
| 4,618,981 | 10/1986 | Ecklund | 381/58 |
| 4,811,395 | 3/1989 | Cleary, Jr. et al. | 381/4 |
| 5,475,315 | 12/1995 | Cabot | 324/628 |
| 5,568,559 | 10/1996 | Makino | 381/56 |
| 5,633,909 | 5/1997 | Fitch | 379/15 |
| 5,644,495 | 7/1997 | Soutar et al. | 364/484 |
| 5,644,505 | 7/1997 | Soutar et al. | 381/58 |
| 5,748,001 | 5/1998 | Cabot | 324/624 |
| 5,757,939 | 5/1998 | Begeja et al. | 381/56 |
| 5,793,956 | 8/1998 | Cox et al. | 379/1 |
| 5,812,506 | 9/1998 | Pietrzykoski et al. | 369/54 |
| 5,818,240 | 10/1998 | Cabot | 324/626 |

FOREIGN PATENT DOCUMENTS

| | | | |
|---|---|---|---|
| 4111705 | 11/1991 | Germany | 381/56 |
| 3-44299 | 2/1991 | Japan | 381/56 |
| 2274341 | 7/1994 | United Kingdom | 381/56 |

*Primary Examiner*—Forester W. Isen
*Assistant Examiner*—Xu Mei
*Attorney, Agent, or Firm*—Jay H. Maioli

[57] ABSTRACT

An apparatus for testing an audio component, such as a compact disc player, automatically runs tests iteratively and suppresses spurious errors generated between test cycles. The player is configured to play a prerecorded test disc encoding a test tone for a certain period of time. The test tone is monitored and changes in frequency or amplitude of the generated signal cause a latch to be set and an interrupt signal to be sent to a controller. The controller increments an error count in response to the interrupt and resets the latch. At the end of the test cycle an end-of-test tone is mixed with the test tone. When the end-of-test tone is detected the latch is disabled for a period of time to prevent signals generated as the player resets to result in spurious errors.

16 Claims, 4 Drawing Sheets

AUTOMATED TESTING APPARATUS FOR ELECTRONIC COMPONENT

BACKGROUND OF THE INVENTION

The present invention relates generally to the field of automated test equipment for performing operational testing on electronic components. More particularly, the present invention relates to a testing system that automatically monitors operational testing of electronic entertainment devices, including compact disc players and tape players, without human supervision and that suppresses spurious error signals generated at the end of a testing cycle.

There is a need for a testing system that will give a manufacturer or repair service confidence that an electronic component will not be subject to intermittent failures.

Intermittent failures are, by their nature, difficult to detect. To test for freedom from such failures, a unit under test (UUT)is operated for a length of time and flaws in the reproduced signal are tallied. If the number of detected flaws is low enough so that the statistical probability of an intermittent failure is acceptable, the equipment is sold or returned to service.

This type of testing requires that the equipment be connected to a testing apparatus for a relatively long period of time, perhaps hours or days. During this period the equipment must be monitored and any errors generated by the equipment logged for later analysis.

For components that play back recorded media, such as compact disc players, testing requires that a test media with a prerecorded signal be loaded into the device. The prerecorded media is then played back repeatedly. Noises generated at the end of a playback cycle, while the optical head is retracting, may result in the logging of spurious errors. To prevent these spurious errors from being counted as flaws the logging system must be reset after each playback cycle.

Resetting the logging system requires the attention of a technician and adds to the cost of the goods or to the cost of repair. In addition, because human intervention is periodically required, testing equipment at facilities that do not operate around the clock is idle after work hours. This represents an additional cost in terms of capital equipment.

For components that have a large number of operational modes, testing for intermittent errors can be laborious. For example, radio receivers typically receive signals across a wide spectrum of frequencies and may use two or three reception modes, i.e., AM, FM, Shortwave. Each mode may need to be tested at several frequencies to assure that intermittent failures will not occur. A testing procedure for such a device requires that a technician be on hand throughout the testing period to reset the UUT and the testing signal generator for each of the tested modes. In addition, error logging must be disabled while the TUT and signal generator are reset to prevent the logging of spurious errors.

There is a need, therefore, for an automated test system for testing electronic devices that can monitor a UUT and track its error history automatically. Automated testing would reduce repair costs by allowing a technician to test a number of devices simultaneously.

The need for automated testing is particularly great in the field of high-volume consumer electronics, for example compact disc players. These devices incorporate delicate mechanical systems that are prone to intermittent failures. Further, these devices are sold in a competitive marketplace that demands lower prices and improved reliability.

SUMMARY OF THE INVENTION

It is therefore an object of the present invention to provide an automated testing system for testing electronic components.

It is another object of the present invention to provide a testing system wherein a series of tests can be performed on a component without the need for human intervention.

It is yet another object of the present invention to provide an automated testing system that interfaces with a personal computer, whereby a technician can control the testing system via a graphic user interface (GUI).

It is a further object of the present invention to provide an automated testing system wherein spurious error signals caused by the normal loss of signal at the end of a test cycle are suppressed.

It is a still further object of the present invention to provide an automated testing system for compact disc players wherein a test disc provides both a test tone and an end-of-test tone and wherein the testing system is responsive to the end-of-test tone.

According to a first aspect of the present invention there is provided a connection to a plurality of outputs from a unit under test (UUT), for example a compact disc player. These connections include right and left speaker channel outputs. Output signals pass through an overload protection module for detecting a high voltage on any of the outputs and for disconnecting all of the outputs if a high voltage is detected. The UUT outputs are then processed by a DC level shifter for adjusting the DC bias in each of the outputs to a predetermined level. The level shifted signals are then sensed by a test tone detector for detecting a test tone generated by the UUT during a test cycle and for detecting any unintended changes in frequency or amplitude of the test tone.

Changes in the test tone frequency or amplitude indicate a flaw in the UUT. A latch is set by the test tone detector when a variation in the test tone is detected. Outputs from the UUT are also monitored by an end-of-test tone detector for detecting a tone generated by the UUT indicating that the test cycle is completed. A controller monitors the latch and logs detected errors. After an error is detected, the controller resets the latch to allow subsequent errors to be detected. A signal from the end-of-test tone detector prevents the latch from being set for a period of time following a test cycle, to allow the UUT to start a new test cycle.

According to a second aspect of the present invention there is provided a test media in the form of a compact disc. Recorded on the compact disc are a plurality of audio tracks. At least the first track contains audio information to generate test tone of a predetermined frequency, amplitude, and duration. The last track contains an end-of-test tone at a second frequency to indicate the completion of the test. A compact disc player fitted with this compact disc forms the UUT of the first aspect.

According to a third aspect of the present invention there is provided, in addition to the apparatus of the first aspect, a signal generator that is controlled by the controller and that outputs a predetermined signal to the UUT. In this aspect, the UUT may be a tuner or an amplifier that accepts and processes input signals to produce an output signal. The signal generator is controlled to produce an output that causes the UUT to produce the test tone for a predetermined period of time and then to produce the end-of-test tone at the end of a test cycle.

According to a fourth aspect of the present invention there is provided a computer that forms the controller of the first and third aspects described above. The computer is provided with software that allows a technician to automatically run multiple iterations of a test sequence according to the first and third aspects. The software is accessed via a graphic user interface (GUI) to modify the test sequence, to observe the results of the error log, to modify the signal generated by the signal generator of the third aspect, and to interrupt the test sequence. The GUI is generated by a program that is designed to run in the background of other programs.

DETAILED DESCRIPTION

Figure 1:
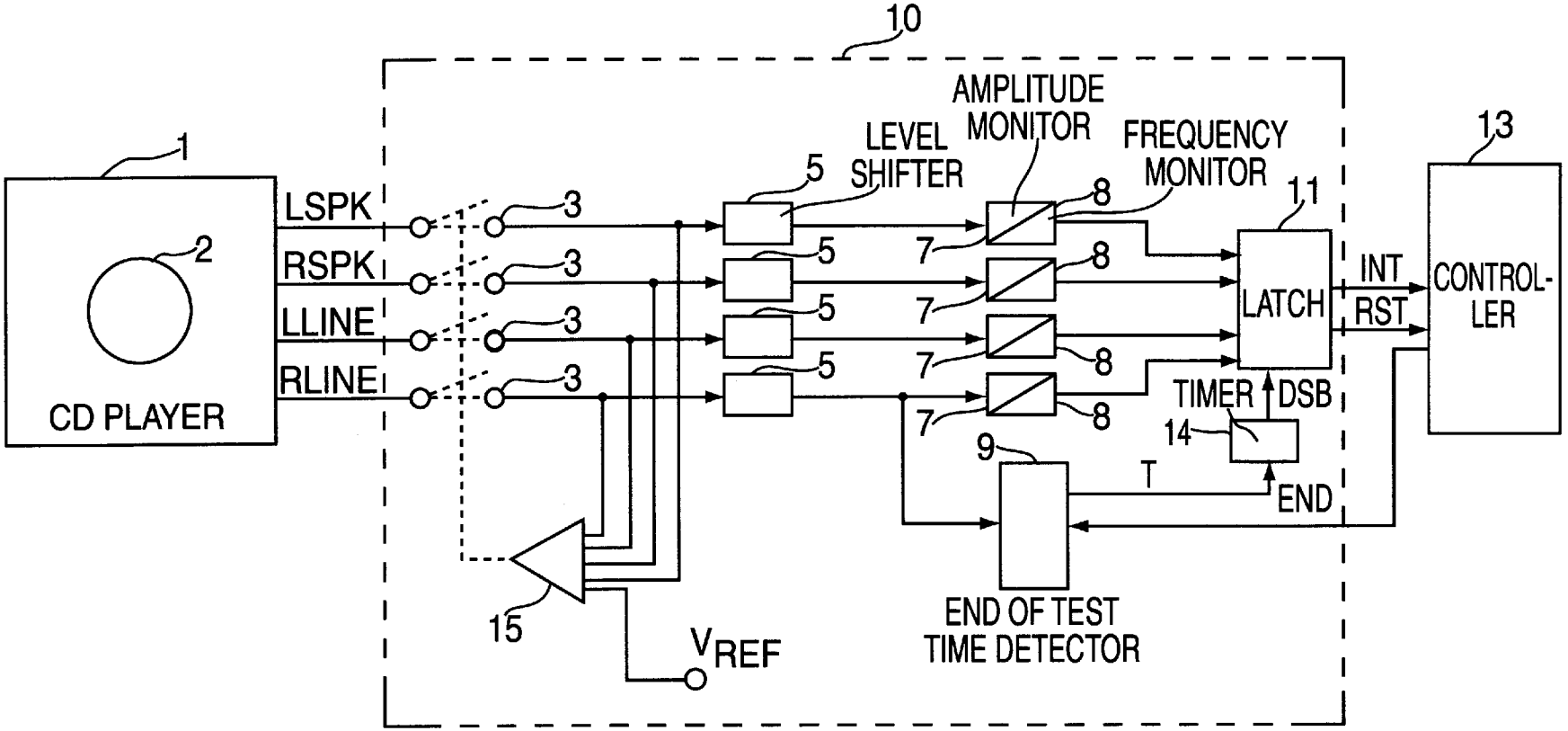
FIG. 1 shows a block diagram of a first embodiment according to the present invention.

In a first embodiment of the present invention, shown in FIG. 1, a compact disc player 1 is connected to a testing system 10. A compact disc 2 encoding a series of test tracks is installed in the player 1. Four outputs from the player 1 correspond to left and right speaker channels and left and right line-out channels labeled LSPK, RSPK, LLINE, and RLINE, respectively.

The outputs of the player 1 are each controlled by a four-pole switch 3 that is normally closed but can be opened by a signal generated by an over-voltage protection circuit 15. The over-voltage protection circuit 15 senses the voltage on each of the output lines and compares them to a voltage reference Vref. If the voltage on any of the lines exceeds Vref then all of the poles of switch 3 are opened to protect the system 10.

Figure 2:
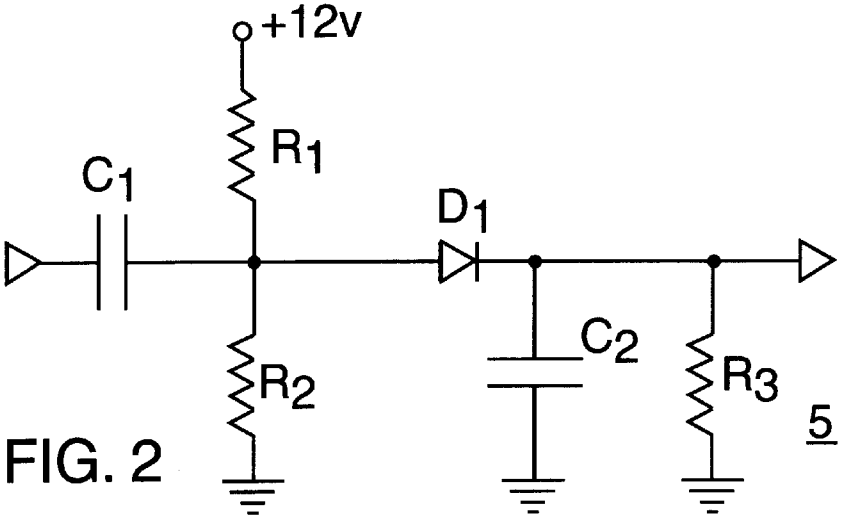
FIG. 2 is a schematic diagram of a level shifter used with the embodiment of FIG. 1.

The output signals are DC level shifted by level shifters 5, and FIG. 2 shows a schematic of one of the level shifters 5.

A signal from the player 1 is applied to one side of capacitor C1. The other side of capacitor C1 is biased by an R1/R2 resistor network, so that the anode of diode D1 has an AC signal component on top of a DC bias voltage. Diode D1 is positively biased so the DC voltage level at the cathode of D1 is determined by the current flowing through D1 into another resistor R3. The DC voltage at the cathode of diode D1 can be selected by choosing the values of the resistors R1, R2, and R3.

The AC signal component from the player 1 appears at the cathode of diode D1 and at the output of the level shifter 5. The AC signal component, as well as any-sudden changes in signal level, will appear across capacitor C2 and will be output by the level shifter 5. Slowly varying changes in DC level will be drained from capacitor C2 by resistor R3.

Signals from the level shifters 5 are then monitored by respective amplitude monitors 7 and test tone frequency monitors 8, as shown in FIG. 1. Amplitude monitors 7 detect sudden changes in the amplitude of the output signals. Frequency monitors 8 detect a shift in signal frequency from an expected frequency value for the output signals.

Figure 3:
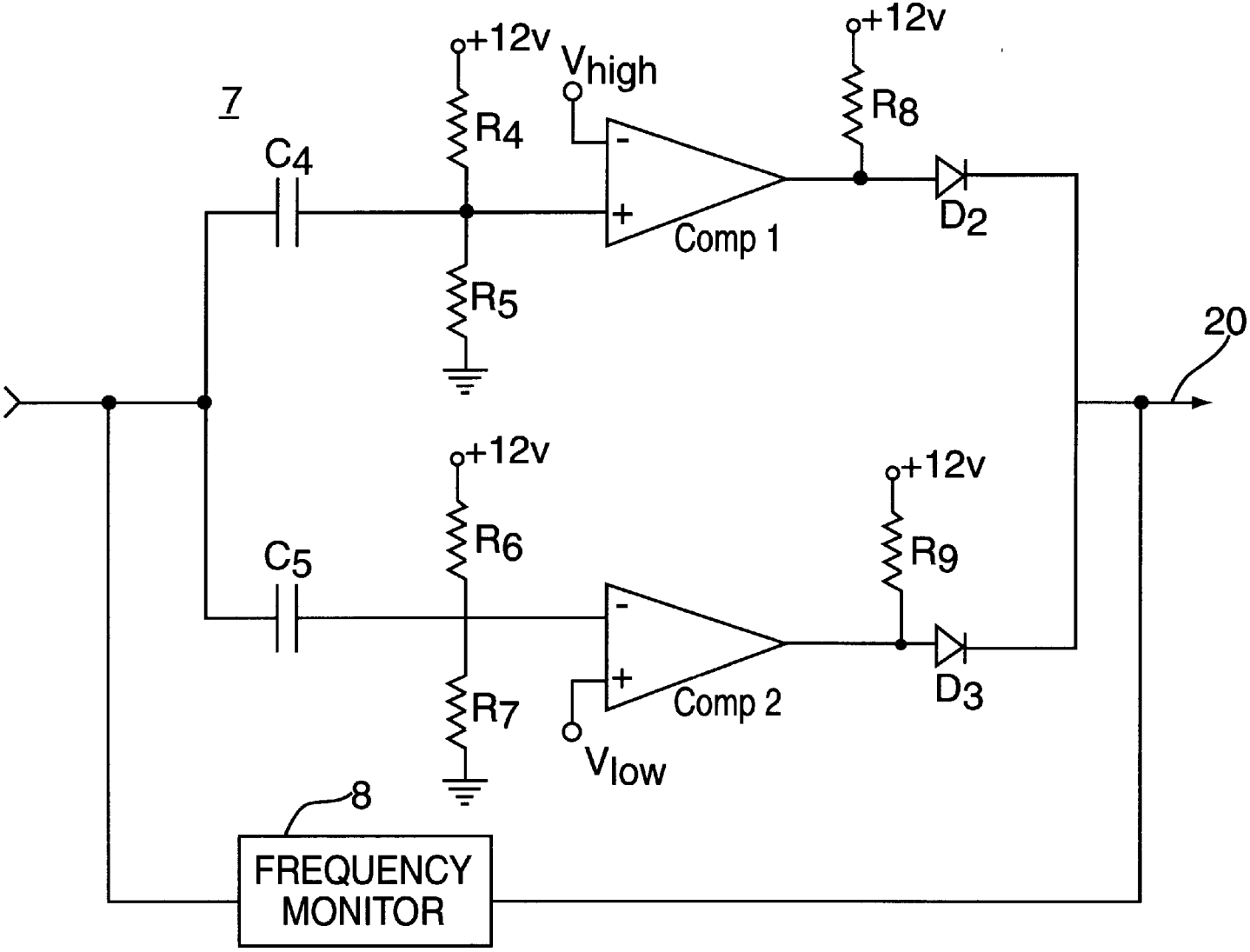
FIG. 3 is a schematic diagram of a test tone detector used with the embodiment of FIG. 1.

FIG. 3 shows an amplitude monitor 7 and frequency monitor 8 for one of the signals from the player 1. Signals are applied to one side of capacitors C4 and C5. The other sides of capacitors C4 and C5 are biased by resistors R4 and R5 and R6 and R7, respectively, to a DC level between the 12 volt supply and ground. The values of capacitors C4, C5 and resistors R4, R5, R6, and R7 are chosen so that sudden changes in amplitude will appear on the output sides of capacitors C4 and C5 before being discharged through the resistor networks.

Voltage comparators, Comp1 and Comp2, compare the signals from the player 1 with upper and lower threshold voltages, Vhigh and Vlow. If the signal amplitude exceeds Vhigh or falls below Vlow one of the comparators will trigger an error signal through output diodes D2 or D3.

The frequency monitor 8 consists of a phase-lock loop circuit with a center frequency at the test tone. In the preferred embodiment the test tone is selected as 3 kHz. If the signal from the player 1 drifts by more than a predetermined amount, for example 100 Hz, from the 3 kHz value an error signal is sent to the output 20.

Error signals from the amplitude monitors 7 and frequency monitors 8 are input to a latch 11. The latch 11 is set by a signal from any one of the amplitude monitors 7 or frequency monitors 8. Setting the latch 11 causes an interrupt signal to appear on the INT line.

A controller 13, which may be a personal computer, monitors the INT line. If an interrupt signal is detected, the controller 13 logs an error in a file corresponding to the player 1 and the sends a signal along the RST line to reset the latch 11. Once the latch 11 is reset it can receive additional error signals from the monitors 7, 8.

Alternatively, the latch 11 may be configured to generate one of a plurality of distinct interrupt signals, each corresponding to one of the output signal lines LSPK, RSPK, LLINE, RLINE. In this case, when the controller 13 detects an interrupt it enters an error on a separate log corresponding to one of the distinct interrupts. In this way errors for each of the signal lines can be monitored separately.

An end-of-test tone detector 9 is connected to one of the output signal lines, for example the RLINE output signal line, as shown in FIG. 1. The end-of-test tone detector 9 consists of a phase-lock loop circuit with a center frequency set to a preselected frequency. The end-of-test tone detector 9 produces a signal when a tone indicating the final track of the disc 2 is being played. In a preferred embodiment the end-of-test tone has a frequency of 10 kHz.

When a 10 kHz signal is detected, the end-of-test tone detector 9 sends a signal along the END line to the controller 13 signaling that all of the test tracks have been played.

The end-of-test tone detector 9 also sends a signal to a timer 14. The timer 14 sets a disable signal on line DSB which causes the latch 11 to ignore error signals from the monitors 7,8 for a predetermined period of time. The disable signal is held for a period of time sufficient to allow the optical head of the player 1 to fully retract. Alternatively, where a multiple disc player is being tested, the latch 11 is disabled for a period of time sufficient for a next test disc to be loaded. By disabling the latch at the end of the test cycle, the present invention prevents spurious error signals from being latched while the player is not actually playing the test tracks and allows multiple iterations of the test cycle. In a preferred embodiment the timer 14 keeps the latch 11 disabled for eight seconds.

The system 10 of the first embodiment is designed to work with a test disc 2 with a predetermined series of signal tracks. In a preferred embodiment the test disc consists of seven tracks. The first five tracks are each ten minutes long and encode a 3 kHz test tone at −20 dB. The sixth track is 9 minutes and fifty seconds long and also encodes the 3 kHz test tone. The last track is ten seconds long and encodes the 3 kHz test tone mixed with a 10 kHz −20 dB end-of-test tone. The test tone and the end-of-test tone are selected to correspond to the center frequencies of the frequency monitors 8 and the end-of-test detector 9, respectively.

Figure 4:
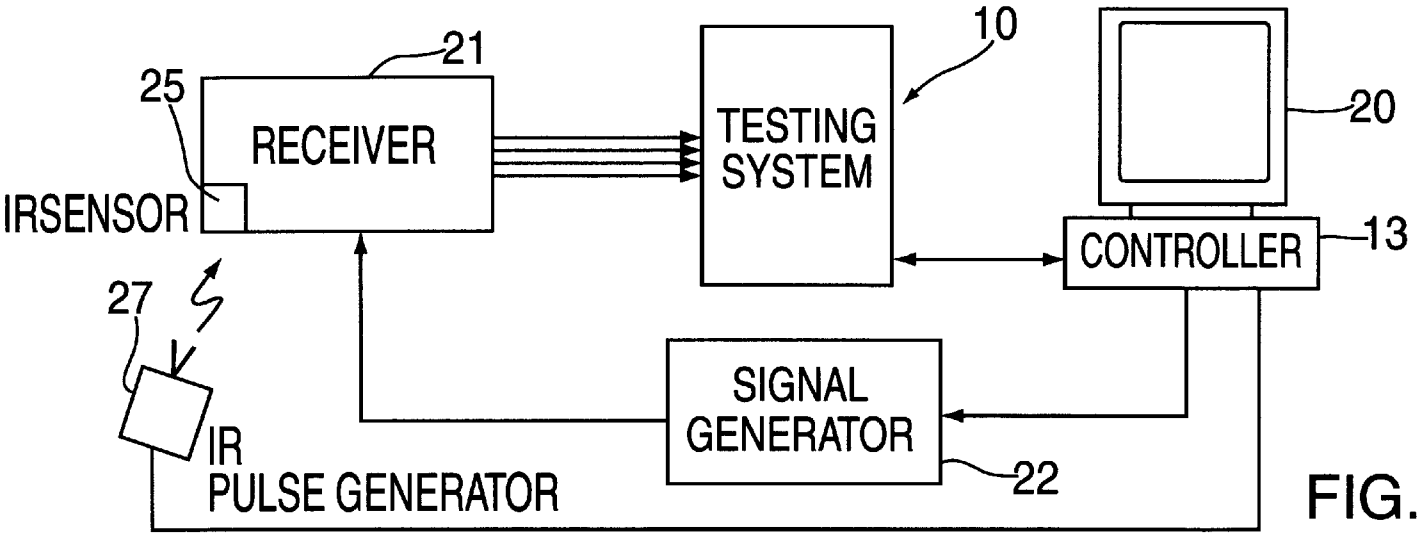
FIG. 4 shows a block diagram of a second embodiment according to the present invention.

FIG. 4 shows a second embodiment of the present invention. The testing system 10 is identical to the system shown in FIGS. 1–3. Here the UUT is a component that accepts signals and generates an output based on those signals. The UUT may be, for example, a radio receiver 21.

In this embodiment the controller 13 is a personal computer equipped with a monitor 20. The computer 13 monitors the latch 11 within the test system 10 in order to log output errors during a test cycle. The computer 13 also sends control signals to a signal generator 22.

In addition, the computer 13 controls an infrared pulse generator 27. The pulse generator 27 is disposed to communicate pulses to the receiver 21 via a remote command sensor 25 on the receiver 21. The remote command sensors 21 is normally used to configure the receiver 21 using a remote commander. The pulse sequences generated by the pulse generator 27 are designed to match a command set recognized by the receiver 21. A pulse sequence set such as the S-link command set may be utilized.

During a test cycle according to this embodiment the pulse generator 27 is commanded to configure the receiver 21 to receive a particular frequency modulated (FM) radio signal. The signal generator 22 is controlled to produce a radio frequency signal at that same frequency and FM modulated with the test tone. The output of the receiver 21 is monitored by the testing system 10 and the controller/computer 13 to detect errors during the test cycle.

After the test cycle the controller/computer 13 commands the signal generator 22 to generate an end-of-test tone modulated on the FM signal causing the receiver to produce the end-of-test tone. This causes the end-of-test tone detector 9 and the timer 14 to disable the latch 11 for a period of time. The controller/computer 13 then commands the pulse generator 27 to configure the receiver 21 to receive a second FM frequency and commands the signal generator 22 to modulate the test tone onto an FM signal at the second FM frequency.

Alternatively, the test tone could be modulated onto an amplitude modulated (AM) signal or a single sideband (SSB) signal and the receiver 21 configured to receive that AM or SSB signal.

In this manner, various functional systems of the receiver 21 may be tested without the need for human intervention. Errors accumulated by the controller/computer 13 can be checked following the test sequence, which can be set to run overnight.

Figure 5:
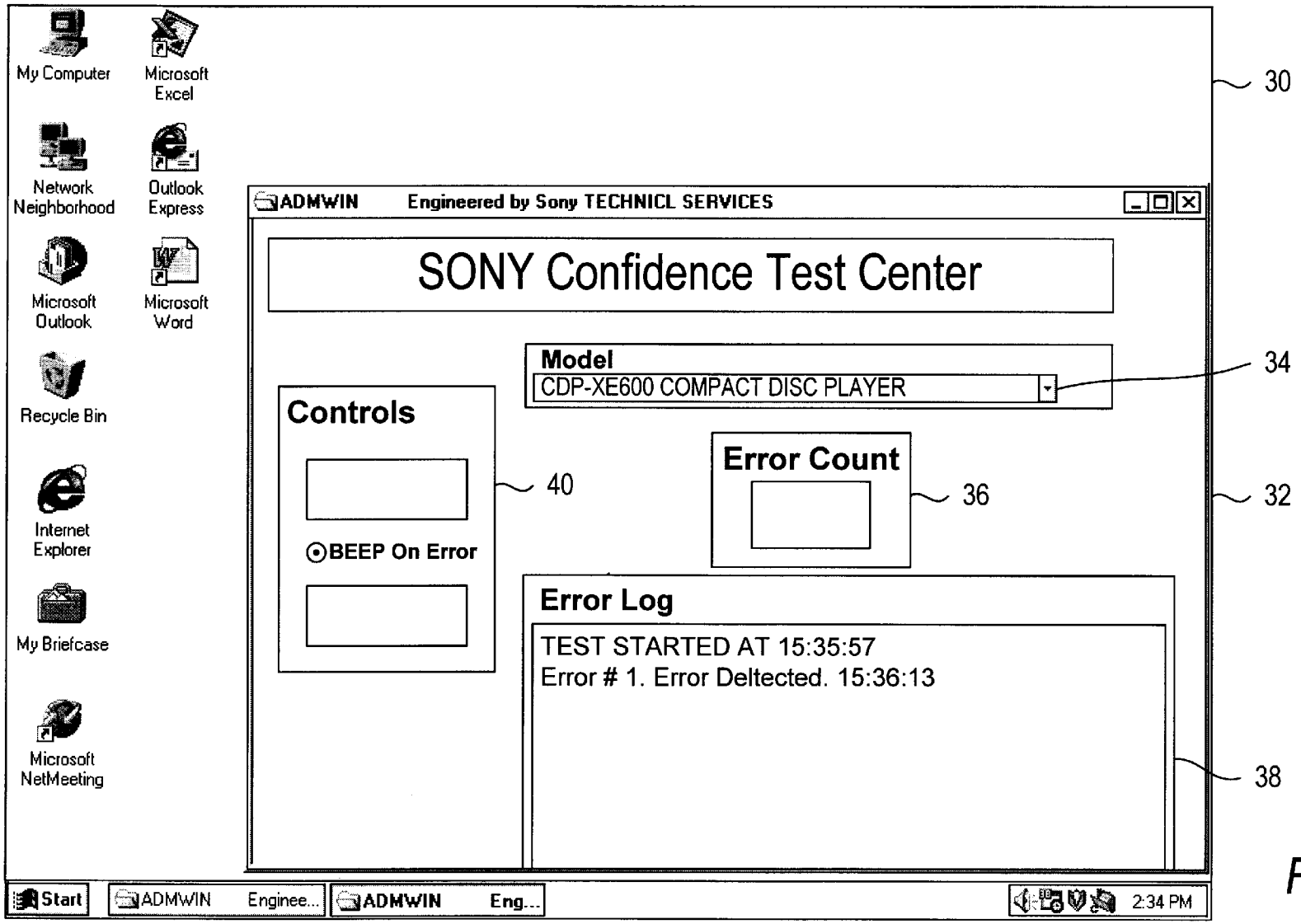
FIG. 5 shows a computer screen display according to a third embodiment of the present invention used in conjunction with the embodiments of FIGS. 1 and 4.

FIG. 5 shows a screen 30 displayed on the monitor 20 according to a third embodiment of the present invention. The screen 30 contains a window 32. Such a screen 30 may be implemented using a computer operating system such as Windows 95™, published by the Microsoft Corporation. Appendix A contains a source code listing of a program that may be used to cause the window 32 to be displayed. This program is designed to run concurrently with other programs in a background mode.

A pull-down menu 34 is provided with a listing of various electronic components that may be tested using the present invention. When a component is selected, here for example a compact disc player, the computer 13 accesses information about the operating characteristics of the selected component.

An error count box 36 is provided to display the number of errors captured by the latch 11 during a test sequence. An error log box 38 is provided to list the time each of the errors was captured. A control box 40 is provided to allow a technician to configure the test sequence, for example, to command the signal generator 22 and pulse generator 27 of the second embodiment to test various functional systems of a UUT 21.

In an alternative embodiment, the latch 11 shown in FIG. 1 generates separate interrupts for each of the output signal lines, and the error log box 38 lists both the time an error was detected and the corresponding output signal experiencing the error.

The embodiments described above are illustrative examples of the present invention. It should be understood that the present invention is not limited to these particular embodiments. Various changes may be effected by one skilled in the art without departing from the spirit or scope of the invention, as defined in the appended claims.

What is claimed is:

1. An apparatus for testing a device that produces an audio signal, the apparatus comprising:

test tone inducing means for causing the device to generate a test tone at a first frequency as the audio signal;

end-of-test tone inducing means for causing the device to generate an end-of-test tone at a second frequency mixed with the test tone, the end-of-test tone being generated upon completing a test cycle;

a test tone detector connected to the device for monitoring the audio signal to detect the test tone and for generating an error pulse if the test tone varies from the first frequency by a predetermined amount;

a latch connected to the test tone detector for setting an interrupt in response to the error pulse;

a controller connected to the latch for detecting the interrupt, for increasing an error count in response to the interrupt, and for resetting the latch; and an end-of-test tone detector connected to the device and to the latch for receiving the audio signal, for detecting the end-of-test tone at the second frequency as part of the audio signal, and for preventing the latch from generating the interrupt, whereby variations in the test tone following the end-of-test tone do not increase the error count.

2. The apparatus according to claim 1 wherein the test tone detector includes a level shifter for receiving the audio signal and shifting a DC bias thereof to a predetermined DC bias level.

3. The apparatus according to claim 1 wherein the test tone detector includes an amplitude detector for monitoring an amplitude of the audio signal and for generating the error pulse if the amplitude varies from a steady-state amplitude by a predetermined amount.

4. The apparatus according to claim 1 further comprising an over-voltage detector for monitoring a voltage of the audio signal and a cut-out switch controlled by the over-voltage detector, wherein the cut-out switch disconnects the device from the apparatus when the over-voltage detector detects a voltage above a predetermined value.

5. The apparatus according to claim 1 wherein the end-of-test tone detector includes a timer for preventing the latch from generating the interrupt for a predetermined period of time.

6. The apparatus according to claim 1 wherein the device is an optical disc player and wherein the test tone inducing means and the end-of-test tone inducing means are encoded tracks of an optical disc.

7. The apparatus according to claim 6 wherein the first frequency is 3 kHz and the second frequency is 10 kHz.

8. The apparatus according to claim 1 wherein the controller includes a computer programmed to provide a graphic user interface.

9. The apparatus according to claim 8 wherein the graphic user interface is generated by a Windows 95™ operating system.

10. The apparatus according to claim 9 wherein the graphic user interface runs concurrently with and in the background of other applications.

11. A testing apparatus comprising:

a component that produces an audio signal in response to an input signal;

a controller;

an input signal generator connected to the component for generating a first input signal causing the component to produce a test tone at a first frequency during a first portion of a testing cycle and for generating a second input signal causing the component to generate an end-of-test tone at a second frequency mixed with the test tone during a second portion of the testing cycle, the input signal generator being controlled by the controller;

a test tone detector connected to the component for monitoring the audio signal to detect the test tone during the first portion of the testing cycle and for generating an error pulse if the test tone varies from the first frequency by a predetermined amount;

a latch connected to the test tone detector and the controller for setting an interrupt in response to the error pulse, wherein the controller monitors the latch for detecting the interrupt and when the interrupt is detected the controller increases an error count in response to the interrupt and resets the latch; and an end-of-test tone detector connected to the component and to the latch for receiving the audio signal, for detecting the end-of-test tone at the second frequency, and for preventing the latch from generating the interrupt, whereby variations in the test tone following the end-of-test tone will not increase the error count.

12. The testing apparatus according to claim 11 wherein the component includes a configuration command receiver for causing the component to assume a commanded configuration and further comprising a configuration command generator connected to the controller, wherein the controller causes the command generator to transmit commands to the configuration command receiver to configure the component according to a predetermined configuration.

13. The testing apparatus according to claim 12 wherein the component is a tuner, the predetermined configuration is a tuning frequency and tuning mode, and the input signal generator generates modulated radio frequency signals at the tuning frequency in the tuning mode.

14. The apparatus according to claim 12 wherein the configuration command generator and the configuration command receiver respectively transmit and receive infrared signals.

15. The apparatus according to claim 14 wherein the infrared signals are arranged according to an S-Link protocol.

16. A method for testing an audio component comprising the steps of:

causing the component to generate a test tone for a predetermined period of time;

monitoring the test tone and if there is a change in the test tone:

generating an error signal;

setting a latch in response to the error signal;

generating an interrupt signal in response to setting of the latch;

monitoring the latch and when the interrupt signal is detected, incrementing an error count and resetting the latch; and causing the component to generate an end-of-test tone mixed with the test tone after the predetermined period of time; and when the end-of-test tone is detected, disabling the latch from being set in response to the error signal.

* * * * *